US007527570B2

(12) United States Patent
Giannetti et al.

(10) Patent No.: US 7,527,570 B2
(45) Date of Patent: May 5, 2009

(54) BALL BAT EXHIBITING OPTIMIZED PERFORMANCE VIA SELECTIVE PLACEMENT OF INTERLAMINAR SHEAR CONTROL ZONES

(75) Inventors: William B. Giannetti, Van Nuys, CA (US); Dewey Chauvin, Siml Valley, CA (US); Hsing-Yen Chuang, Studio City, CA (US)

(73) Assignee: Easton Sports, Inc., Van Nuys, CA (US)

( * ) Notice: Subject to any disclaimer, the term of this patent is extended or adjusted under 35 U.S.C. 154(b) by 0 days.

(21) Appl. No.: 11/873,326

(22) Filed: Oct. 16, 2007

(65) Prior Publication Data

US 2008/0032833 A1 Feb. 7, 2008

Related U.S. Application Data

(63) Continuation of application No. 11/457,542, filed on Jul. 14, 2006, now Pat. No. 7,361,107, which is a continuation of application No. 10/903,493, filed on Jul. 29, 2004, now Pat. No. 7,115,054.

(51) Int. Cl.
*A63B 59/06* (2006.01)

(52) U.S. Cl. ..... 473/568

(58) Field of Classification Search ..... 473/457, 473/519, 520, 564–568, 300–303, 549–552
See application file for complete search history.

(56) References Cited

U.S. PATENT DOCUMENTS 1,611,858 A 12/1926 Middlekauff
2,031,161 A 2/1936 Hamel
4,848,745 A 7/1989 Bohannan et al.
4,931,247 A 6/1990 Yeh
4,940,247 A 7/1990 Magadini
5,035,428 A * 7/1991 Bartkowicz ..... 473/568
5,131,651 A 7/1992 You
5,301,940 A 4/1994 Seki et al.
5,303,917 A 4/1994 Uke (Continued)

OTHER PUBLICATIONS

Mustone, et al., "Using LS-DYNA to Develop a Baseball Bat Performance and Design Tool," 6th International LS-DYNA Users Conference, Apr. 9-10, Detroit, MI (2000).

(Continued)

*Primary Examiner*—Mark S Graham
(74) *Attorney, Agent, or Firm*—Rodger K. Carreyn; Perkins Coie LLP

(57) ABSTRACT

A ball bat exhibits improved barrel performance in regions located away from the "sweet spot" of the bat barrel, as a result of strategic placement of interface shear control zones ("ISCZs") in the barrel. The ball bat includes a barrel having a first region adjacent to the tapered section of the ball bat, a second region adjacent to the free end of the barrel, and a third region located between the first and second regions, that includes the sweet spot of the barrel. The first and second regions each include at least one interface shear control zone. The third region includes at least one fewer interface shear control zone than at least one of the first and second regions. ISCZs may also be strategically placed in the bat handle and/or the tapered section of the ball bat to improve the compliance and overall performance of the ball bat.

18 Claims, 5 Drawing Sheets

U.S. PATENT DOCUMENTS

| | | | |
|---|---|---|---|
| 5,362,046 | A | 11/1994 | Sims |
| 5,364,095 | A | 11/1994 | Easton et al. |
| 5,380,003 | A | 1/1995 | Lanctot |
| 5,395,108 | A | 3/1995 | Souders et al. |
| 5,415,398 | A | 5/1995 | Eggiman |
| 5,482,270 | A | 1/1996 | Smith |
| 5,511,777 | A | 4/1996 | McNeely |
| 5,516,097 | A | 5/1996 | Huddleston |
| 5,593,158 | A | 1/1997 | Filice et al. |
| 5,624,115 | A | 4/1997 | Baum |
| 5,676,610 | A | 10/1997 | Bhatt et al. |
| 5,711,728 | A | 1/1998 | Marcelo |
| 5,759,113 | A | 6/1998 | Lai et al. |
| 5,772,541 | A | 6/1998 | Buiatti et al. |
| 5,833,561 | A | 11/1998 | Kennedy et al. |
| 5,899,823 | A | 5/1999 | Eggiman |
| 5,964,673 | A | 10/1999 | MacKay, Jr. |
| 6,007,439 | A | 12/1999 | MacKay, Jr. |
| 6,022,282 | A | 2/2000 | Kennedy et al. |
| 6,042,493 | A | 3/2000 | Chauvin et al. |
| 6,053,828 | A | 4/2000 | Pitsenberger |
| 6,086,490 | A | 7/2000 | Spangler et al. |
| 6,176,795 | B1 | 1/2001 | Schullstrom |
| 6,344,007 | B1 | 2/2002 | Feeney et al. |
| 6,352,485 | B1 | 3/2002 | Philpot et al. |
| 6,383,101 | B2 | 5/2002 | Eggiman et al. |
| 6,398,675 | B1 | 6/2002 | Eggiman et al. |
| 6,425,836 | B1 | 7/2002 | Misono et al. |
| 6,440,017 | B1 | 8/2002 | Anderson |
| 6,461,260 | B1 | 10/2002 | Higginbotham |
| 6,497,631 | B1 | 12/2002 | Fritzke et al. |
| 6,508,731 | B1 | 1/2003 | Feeney et al. |
| 6,663,517 | B2 | 12/2003 | Buiatti et al. |
| 6,709,352 | B1 | 3/2004 | Albin |
| 6,723,012 | B1 | 4/2004 | Sutherland |
| 6,729,983 | B1 | 5/2004 | Vakili et al. |
| 6,733,404 | B2 | 5/2004 | Fritzke et al. |
| 6,761,653 | B1 | 7/2004 | Higginbotham et al. |
| 6,764,419 | B1 | 7/2004 | Giannetti et al. |
| 6,776,735 | B1 | 8/2004 | Belanger et al. |
| 6,863,628 | B1 | 3/2005 | Brandt |
| 6,866,598 | B2 | 3/2005 | Giannetti et al. |
| 6,869,372 | B1 | 3/2005 | Higginbotham et al. |
| 2001/0014634 | A1 | 8/2001 | MacKay, III |
| 2002/0128095 | A1* | 9/2002 | Flood ..... 473/568 |
| 2002/0198071 | A1 | 12/2002 | Snow |
| 2003/0186763 | A1 | 10/2003 | Eggiman et al. |
| 2003/0195066 | A1 | 10/2003 | Eggiman et al. |
| 2004/0077439 | A1 | 4/2004 | Eggiman et al. |
| 2004/0176197 | A1 | 9/2004 | Sutherland |
| 2005/0070384 | A1 | 3/2005 | Fitzgerald et al. |
| 2005/0143203 | A1 | 6/2005 | Souders et al. |
| 2005/0227795 | A1 | 10/2005 | Fritzke |

OTHER PUBLICATIONS

Reynolds, et al., "Hand-Arm Vibration, Part III: Subjective Response Characteristics of Individuals to Hand-Induced Vibrations," *Journal of Sound and Vibration*, 51(2): 267-282 (1977).

Belknap, "Vibration Suppression of Thin-Walled Composite Tubes Using Embedded Viscoelastic Layers," *Proceedings of Damping*, Feb. 13-15, San Diego, CA (1991).

Combined International Search Report and Written Opinion of the International Searching Authority for International Application No. PCT/US05/26872; issued by the ISA/US;dated Dec. 5, 2005.

* cited by examiner

BALL BAT EXHIBITING OPTIMIZED PERFORMANCE VIA SELECTIVE PLACEMENT OF INTERLAMINAR SHEAR CONTROL ZONES

This application is a Continuation of U.S. patent application Ser. No. 11/457,542, filed Jul. 14, 2006, now U.S. Pat. No. 7,361,107, which is a Continuation of U.S. patent application Ser. No. 10/903,493, filed Jul. 29, 2004, now issued as U.S. Pat. No. 7,115,054, both of which are incorporated herein by reference.

BACKGROUND

Baseball and softball bat manufacturers are continually attempting to develop ball bats that exhibit increased durability and improved performance characteristics. Ball bats typically include a handle, a barrel, and a tapered section joining the handle to the barrel. The outer shell of these bats is generally formed from aluminum or another suitable metal, and/or one or more composite materials.

Barrel construction is particularly important in modern bat design. Barrels having a single-wall construction, and more recently, a multi-wall construction, have been developed. Modern ball bats typically include a hollow interior, such that the bats are relatively lightweight and allow a ball player to generate substantial "bat speed" or "swing speed."

Single-wall bats generally include a single tubular spring in the barrel section. Multi-wall barrels typically include two or more tubular springs, or similar structures, that may be of the same or different material composition, in the barrel section. The tubular springs in these multi-wall bats are typically either in contact with one another, such that they form friction joints, are bonded to one another with weld or bonding adhesive, or are separated from one another forming frictionless joints. If the tubular springs are bonded using a structural adhesive, or other structural bonding material, the barrel is essentially a single-wall construction. U.S. Pat. No. 5,364,095, the disclosure of which is herein incorporated by reference, describes a variety of bats having multi-walled barrel constructions.

It is generally desirable to have a bat barrel that is durable, while also exhibiting optimal performance characteristics. Hollow bats typically exhibit a phenomenon known as the "trampoline effect," which essentially refers to the rebound velocity of a ball leaving the bat barrel as a result of flexing of the barrel wall(s). Thus, it is desirable to construct a ball bat having a high "trampoline effect," so that the bat may provide a high rebound velocity to a pitched ball upon contact.

The "trampoline effect" is a direct result of the compression and resulting strain recovery of the bat barrel. During this process of barrel compression and decompression, energy is transferred to the ball resulting in an effective coefficient of restitution (COR) of the barrel, which is the ratio of the post impact ball velocity to the incident ball velocity (COR=Vpost impact/Vincident). In other words, the "trampoline effect" of the bat improves as the COR of the bat barrel increases.

Multi-walled bats were developed in an effort to increase the amount of acceptable barrel deflection beyond that which is possible in typical single-wall designs. These multi-walled constructions generally provide added barrel deflection, without increasing stresses beyond the material limits of the barrel materials. Accordingly, multi-wall barrels are typically more efficient at transferring energy back to the ball, and the more flexible property of the multi-wall barrel reduces undesirable deflection and deformation in the ball, which is typically made of highly inefficient material.

An example of a multi-wall ball bat 100 is illustrated in FIG. 1. The barrel 102 of the ball bat 100 includes an inner wall 104 separated from an outer wall 106 by an interface shear control zone 108 or layer, such as an elastomeric layer, a friction joint, a bond-inhibiting layer, or another suitable layer. Each of the inner and outer walls 104, 106 includes one or more plies 110 of one or more fiber-reinforced composite materials. Alternatively, one or both of the inner and outer walls 104, 106 may include a metallic material, such as aluminum. A ball bat having this construction is described in detail U.S. patent application Ser. No. 10/712,251, filed on Nov. 13, 2003, the disclosure of which is hereby incorporated by reference.

One way that a multi-wall bat differs from a single-wall bat is that there is no shear energy transfer through the interface shear control zone(s) ("ISCZ") in the multi-wall barrel, i.e., through the region(s) between the barrel walls that de-couple the shear interface between those walls. As a result of strain energy equilibrium, this shear energy, which creates shear deformation in a single-wall barrel, is converted into bending energy in a multi-wall barrel. And since bending deformation is more efficient in transferring energy than is shear deformation, the walls of a multi-wall bat typically exhibit a lower strain energy loss than does a single wall design. Thus, multi-wall barrels are generally preferred over single-wall designs for producing efficient bat-ball collision dynamics, or a better "trampoline effect."

To illustrate, FIG. 2 shows a graphical comparison of the relative performance characteristics of a typical wood bat barrel, a typical single-wall bat barrel, and a typical double-wall bat barrel. As FIG. 2 illustrates, double-wall bats generally perform better along the length of the barrel than do single-wall bats and wood bats. While double-wall bats have generally produced improved results along the barrel length, these results still decrease to an extent as impact occurs away from the barrel's "sweet spot."

The sweet spot is the impact location in the barrel where the transfer of energy from the bat to the ball is maximal (i.e., where the trampoline effect is greatest), while the transfer of energy to a player's hands is minimal. The sweet spot is generally located at the intersection of the bat's center of percussion (COP), and the first three fundamental nodes of vibration. This location, which is typically about 4 to 8 inches from the free end of the barrel (it is shown at 6 inches from the free end of the barrel in FIG. 2, by way of example), does not move when the bat is vibrating in its first (or fundamental) bending mode. As a result, when a ball impacts the sweet spot, the bat does not vibrate, and none of the initial energy of the ball is lost to the bat. Moreover, a player swinging the bat does not feel vibration when the ball impacts the sweet spot.

The barrel region between the sweet spot and the free end of the barrel, and the barrel region between the sweet spot and the tapered section of the bat, in particular, do not exhibit the optimal performance characteristics that occur at the sweet spot. Indeed, in a typical ball bat, the barrel performance, or trampoline effect, decreases considerably as the impact location moves away from the sweet spot. As a result, a player is required to make very precise contact with a pitched ball to achieve optimum results, which is generally very challenging. Thus, a need exists for a ball bat that exhibits improved performance, or trampoline effect, at barrel regions away from the sweet spot.

SUMMARY

The invention is directed to a ball bat that exhibits improved feel, compliance, and/or performance as a result of strategic placement of interface shear control zones in the bat handle and/or other regions of the ball bat.

Other features and advantages of the invention will appear hereinafter. The features of the invention described above can be used separately or together, or in various combinations of one or more of them. The invention resides as well in subcombinations of the features described.

BRIEF DESCRIPTION OF THE DRAWINGS

In the drawings, wherein the same reference number indicates the same element throughout the several views.

DETAILED DESCRIPTION OF THE DRAWINGS

Figure 3:
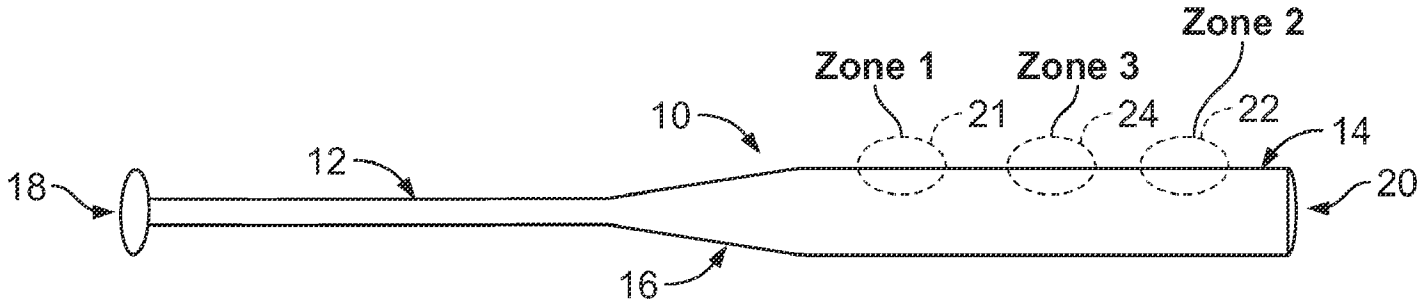
FIG. 3 is side view of a ball bat.

Turning now in detail to the drawings, as shown in FIG. 3, a baseball or softball bat 10, hereinafter collectively referred to as a "ball bat" or "bat," includes a handle 12, a barrel 14, and a tapered section 16 joining the handle 12 to the barrel 14. The free end of the handle 12 includes a knob 18 or similar structure. The barrel 14 is preferably closed off by a suitable cap 20 or plug. The interior of the bat 10 is preferably hollow, which allows the bat 10 to be relatively lightweight so that ball players may generate substantial bat speed when swinging the bat 10.

The ball bat 10 preferably has an overall length of 20 to 40 inches, more preferably 26 to 34 inches. The overall barrel diameter is preferably 2.0 to 3.0 inches, more preferably 2.25 to 2.75 inches. Typical bats have diameters of 2.25, 2.625, or 2.75 inches. Bats having various combinations of these overall lengths and barrel diameters, as well as any other suitable dimensions, are contemplated herein. The specific preferred combination of bat dimensions is generally dictated by the user of the bat 10, and may vary greatly between users.

For purposes of this discussion, as illustrated in FIGS. 3-7, the bat barrel 14 is divided into three zones. The first zone 21, or "Zone 1," extends approximately from the tapered section 16 of the ball bat 10 to a location near the "sweet spot" (as described above) of the bat barrel 14. The second zone 22, or "Zone 2," extends approximately from the free end of the bat barrel 14 to a location near the sweet spot. The third zone 24, or "Zone 3," extends between the first and second zones 21, 22, and includes the sweet spot of the barrel 14. The actual dimensions and locations of these zones may vary, as may the total number of zones. For example, Zone 1 may extend into the tapered section 16 of the ball bat 10. For ease of description, however, the three zones 21, 22, 24 detailed above will be described herein.

The bat barrel 14 preferably comprises a plurality of composite plies 25. The composite materials that make up the plies are preferably fiber-reinforced, and may include glass, graphite, boron, carbon, aramid, ceramic, kevlar, metallic, and/or any other suitable reinforcement material, preferably in epoxy form. Each composite ply preferably has a thickness of approximately 0.003 to 0.020 inches, more preferably 0.005 to 0.008 inches. Alternatively, nano-tubes, such as high-strength carbon nano-tube composite structures, may be used to construct the bat barrel 14.

As explained above, increasing the number of walls in a bat barrel increases the acceptable deflection in the bat barrel, and also converts shear energy into bending energy, via the strategic placement of one or more ISCZs. As a result, the bat's trampoline effect is improved. In existing multi-wall bats, however, optimum results are not achieved throughout the entire length of the barrel, since barrel performance naturally deteriorates the further that impact occurs from the sweet spot.

Figure 11:
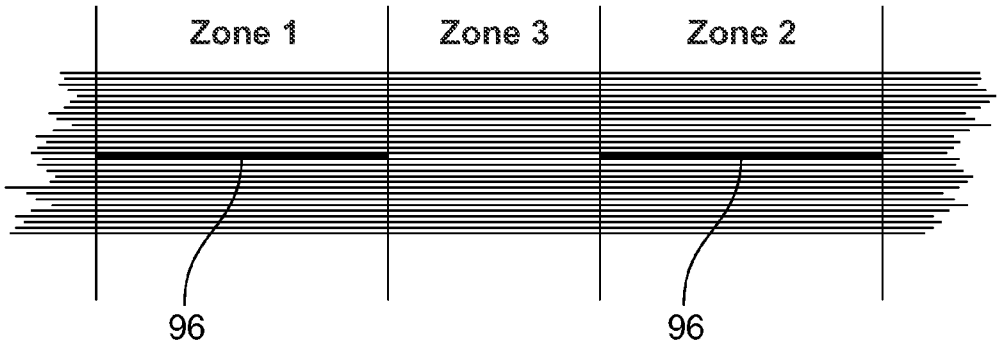

To improve barrel performance in Zones 1 and/or 2, a separate "multi-wall" approach, created by strategic placement of ISCZs in one or both of those zones, may be utilized (see, for example, FIG. 11, including ISZCs 96 in Zones 1 and 2). Each ISCZ used preferably has a radial thickness of approximately 0.001 to 0.010 inches, more preferably 0.005 to 0.006 inches. Any other suitable size ISCZ may alternatively be used. An ISCZ may include a bond-inhibiting layer, a friction joint, a sliding joint, an elastomeric joint, an interface between two dissimilar materials (e.g., aluminum and a composite material), or any other suitable means for separating the barrel into "multiple walls." If a bond-inhibiting layer is used, it is preferably made of a fluoropolymer material, such as Teflon® (polyfluoroethylene), FEP (fluorinated ethylene propylene), ETFE (ethylene tetrafluoroethylene), PCTFE (polychlorotrifluoroethylene), or PVF (polyvinyl fluoride), and/or another suitable material, such as PMP (polymethylpentene), nylon (polyamide), or cellophane.

Figure 4:
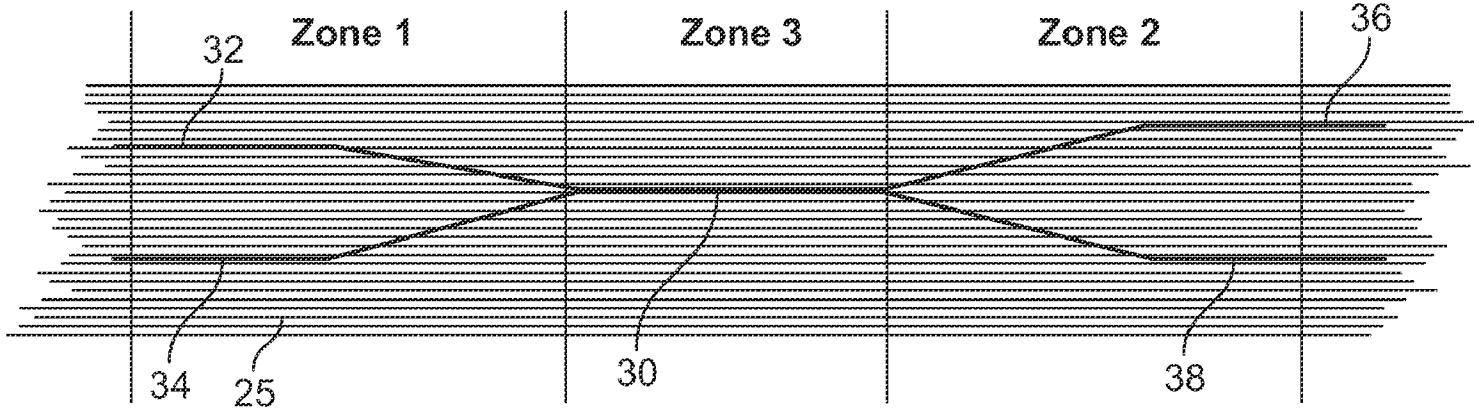
FIGS. 4-7 and 11 are cross-sections of Zones 1-3 of the bat barrel shown in FIG. 3, according to five separate "multi-wall" embodiments.

In a first barrel embodiment shown in FIG. 4, a first ISCZ 30 is located in Zone 3 of the bat barrel 14. The first ISCZ 30 is preferably located at or near the neutral axis of the bat barrel 14, where the shear stresses in the barrel 14 are the highest. In this manner, an optimal amount of shear stress can be converted into bending stress. The first ISCZ 30 may alternatively be located at any other radial location in Zone 3 of the bat barrel 14. The neutral axis is located approximately at the radial midpoint of the barrel wall if the barrel 14 is made up of homogeneous isotropic layers. If more than one composite material is used in the barrel 14, and/or if the material is not uniformly distributed, the neutral axis may reside at a different radial location.

For ease of description, the composite barrel material(s) used in the embodiments shown in FIGS. 4-7 will be considered to be homogeneous, isotropic layers, such that the neutral axis of the barrel 14 is located approximately at the radial midpoint of the barrel wall. In practice, however, any suitable combination of composite and/or metallic materials may be used to construct the barrel 14, such that the neutral axis may be located at other locations in the barrel 14. Moreover, once an ISCZ is added to the barrel 14, it divides the barrel 14 into two barrel "walls," each of which has its own neutral axis, as described in detail in U.S. patent application Ser. No. 10/712,251.

Returning to the first embodiment shown in FIG. 4, Zone 1 includes two ISCZs 32, 34, and Zone 2 includes two ISCZs 36, 38. Each of the ISCZs 32, 34, 36, 38 may be located approximately at thirds of the radial barrel thickness, or may be positioned in another manner. By locating two ISCZs in each of Zones 1 and 2 of the bat barrel 14, those regions essentially perform as tri-wall structures, and thus exhibit increased deflection as compared to Zone 3, which is essentially a double-wall structure. As a result, the barrel deflection and trampoline effect of Zones 1 and 2 are improved relative to Zone 3, thus causing them to better approximate the performance of Zone 3 of the bat barrel 14. Accordingly, when a ball impacts the barrel 14 at either Zone 1 or Zone 2, the barrel 14 produces a trampoline effect that is closer to that which is produced at the sweet spot than do existing ball bats.

In the first embodiment shown in FIG. 4, the ISCZs 32, 34, 36, 38 are oriented such that they are continuous with the first ISCZ 30 in Zone 3. Additionally, the ISCZs 32, 34 in Zone 1 are substantially symmetrical with the ISCZs 36, 38 in Zone 3. One or more of the ISCZs 32, 34, 36, 38 may alternatively be discontinuous with the first ISCZ 30, and the ISCZs 32, 34 in Zone 1 may be asymmetrical with the ISCZs 36, 38 in Zone 3, as described below.

Figure 5:
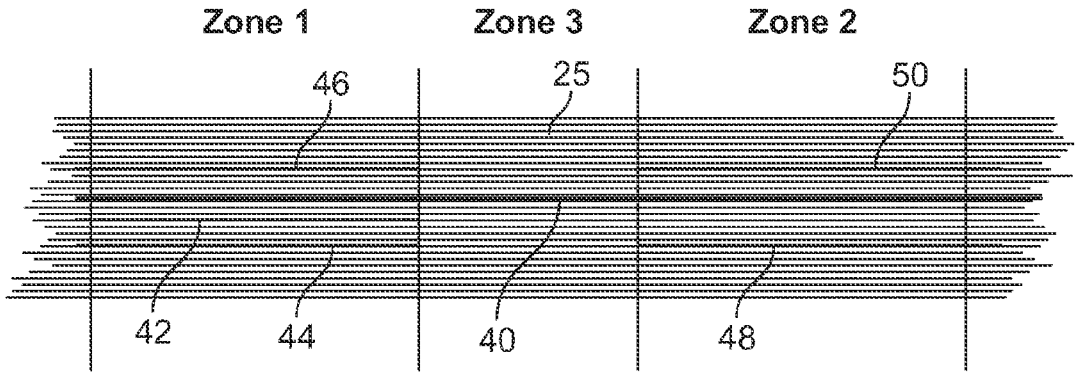
Figure 6:
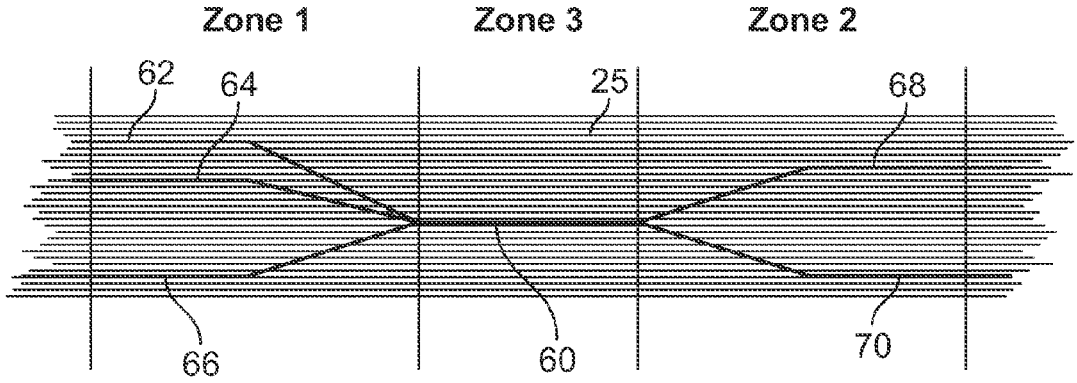

In the barrel embodiments shown in FIGS. 5 and 6, a greater number of ISCZs are located in Zone 1 than in Zone 2 of the bat barrel 14. Such an arrangement may be preferable due to the effects of rotational inertia. During a typical bat swing, the rotational inertia produced in Zone 1 is less than that produced in Zone 2, due to the relative proximity of Zone 1, as compared to Zone 2, to the bat handle 12. Accordingly, bat performance is typically inferior in Zone 1 than in Zone 2. To counteract this difference in performance, in the embodiments shown in FIGS. 5 and 6, a greater number of ISCZs are included in Zone 1 than in Zone 2, to increase the barrel deflection in Zone 1 to a greater extent than in Zone 2.

In the barrel embodiment shown in FIG. 5, a continuous ISCZ 40 runs through Zones 1, 2, and 3, approximately at the radial midpoint of the barrel wall. Two separate discontinuous ISCZs 42, 44 are located in Zone 1 between the ISCZ 40 and the central axis of the bat barrel 14, while an additional discontinuous ISCZ 46 is located in Zone 1 between the ISCZ 40 and the outer surface of the bat barrel 14. Thus, Zone 1 includes a total of four ISCZs, such that the barrel 14 essentially performs like a 5-wall structure in Zone 1. Zone 2 includes one discontinuous ISCZ 48 located between the ISCZ 40 and the central axis of the bat barrel 14, add an additional discontinuous ISCZ 50 located between the ISCZ 40 and the outer surface of the bat barrel 14. Thus, Zone 2 includes a total of three ISCZs, such that the barrel 14 essentially performs like a 4-wall structure in Zone 2.

In the barrel embodiment shown in FIG. 6, Zone 3 includes one ISCZ 60 located approximately at the radial midpoint of the barrel wall. Zone 1 includes two ISCZs 62, 64 located between the radial midpoint and the outer surface of the barrel wall, and one ISCZ 66 located between the radial midpoint of the barrel wall and the central axis of the barrel 14. Thus, Zone 1 includes a total of three ISCZs, such that the barrel 14 essentially performs like a 4-wall structure in Zone 1. Zone 2 includes one ISCZ 68 located between the radial midpoint and the outer surface of the barrel wall, and one ISCZ 70 located between the radial midpoint of the barrel wall and the central axis of the barrel 14. Thus, Zone 2 includes a total of two ISCZs, such that the barrel 14 essentially performs like a 3-wall structure in Zone 2. The three ISCZs 62, 64, 66 in Zone 1, and the two ISCZs 68, 70 in Zone 2, are all continuous with the ISCZ 60 in Zone 3.

The barrel embodiments shown in FIGS. 5 and 6 illustrate the design flexibility contemplated by the present invention. For example, one or more ISCZs in Zones 1 and 2 may be continuous or discontinuous with one or more ISCZs in Zone 3, one or more ISCZs in any of Zones 1-3 may be located between the radial midpoint and the outer surface of the barrel wall, at or near the radial midpoint of the barrel wall, and/or between the radial midpoint of the barrel wall and the central axis of the bat barrel 14, etc. Additionally, Zones 1 and 2 may include the same or a different number of ISCZs than one another.

Importantly, the termination of an ISCZ need not occur specifically where two zones meet. Indeed, an ISCZ may overlap, or reside in, more than one zone, and the zones may be wider or narrower than those which are depicted in the drawings. Moreover, a greater or lesser number of zones may be specified. Indeed, the "zones" are used for illustrative purposes only, and do not provide a physical or theoretical barrier of any kind. Thus, ISCZs may be positioned in the bat barrel 14 (as well as in the tapered section 16 and the handle 12) at a wide variety of locations, according to an infinite number of designs, to achieve desired barrel and overall ball bat performance characteristics.

To this end, the invention is generally directed to a ball bat having a greater number of ISCZs in at least one barrel region located away from the sweet spot, than the number of ISCZs that are located in a barrel region including the sweet spot, in order to provide improved barrel deflection and trampoline effect in those regions. Additionally, in some embodiments, it may be desirable to include a greater number of ISCZs in a barrel region between the tapered section of the bat and the sweet spot, than in a region between the sweet spot and the free end of the barrel, to compensate for the differences in the effects of rotational inertia in those regions. It is recognized, however, that any suitable number of ISCZs may be located in any regions of the barrel (and other portions of the ball bat), in any suitable configuration, depending on the design goals for a particular ball bat.

Figure 7:
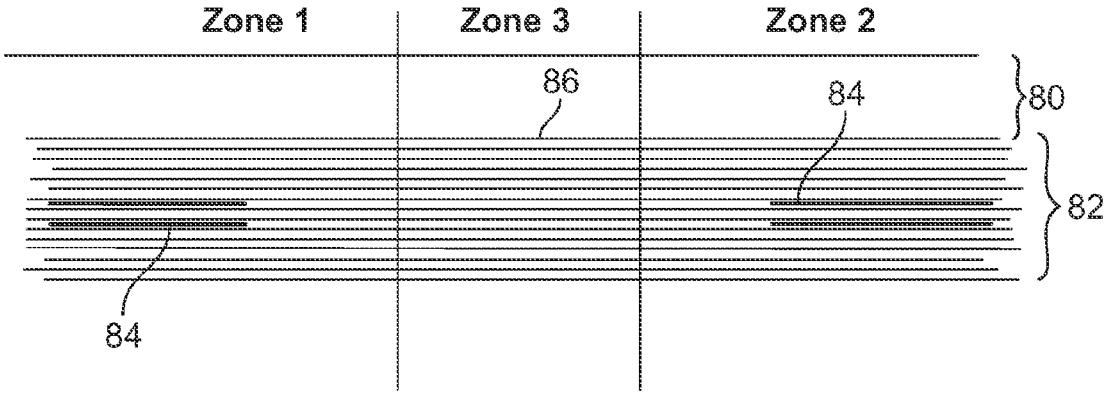

FIG. 7 illustrates an alternative barrel embodiment in which the bat barrel 14 includes a metal outer region 80 and a composite inner region 82. The metal outer region 80 is preferably separated from the composite inner region 82 by a suitable ISCZ 86, such as a bond-inhibiting layer. Alternatively, the non-bonded interface between the metal outer region 80 and the composite inner region may itself form an ISCZ.

The metal outer region 80 preferably includes aluminum and/or another suitable metallic material. The composite inner region 82 preferably includes one or more ISCZs 84, in at least Zones 1 and 2 of the barrel 14, to provide increased barrel deflection in those regions. This hybrid metal/composite construction provides increased durability, due to the presence of the metal outer region 80, while still providing the advantages of increased regional barrel deflection, due to the placement of one or more ISCZs in specific zones of the composite inner region 82. In an alternative embodiment, the barrel 14 may include a composite outer region and a metal inner region.

Figure 1:
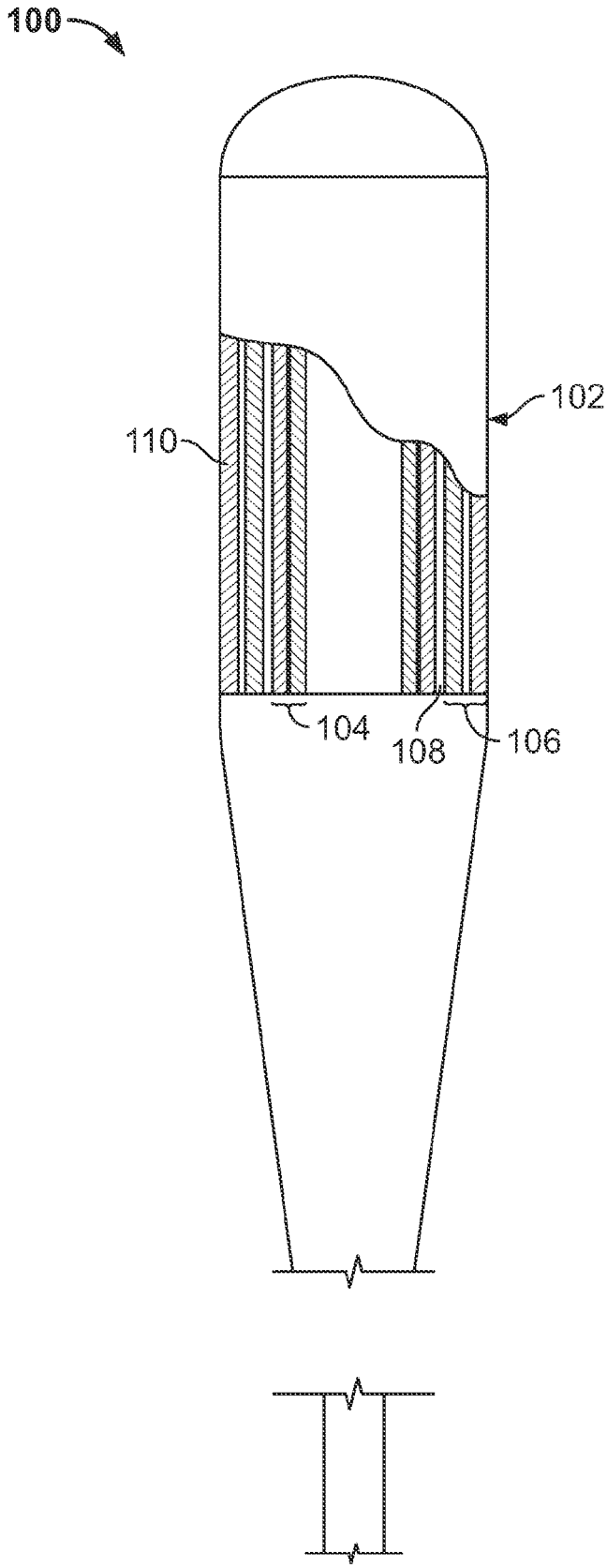
FIG. 1 is a partially cutaway view of a multi-wall ball bat.
Figure 2:
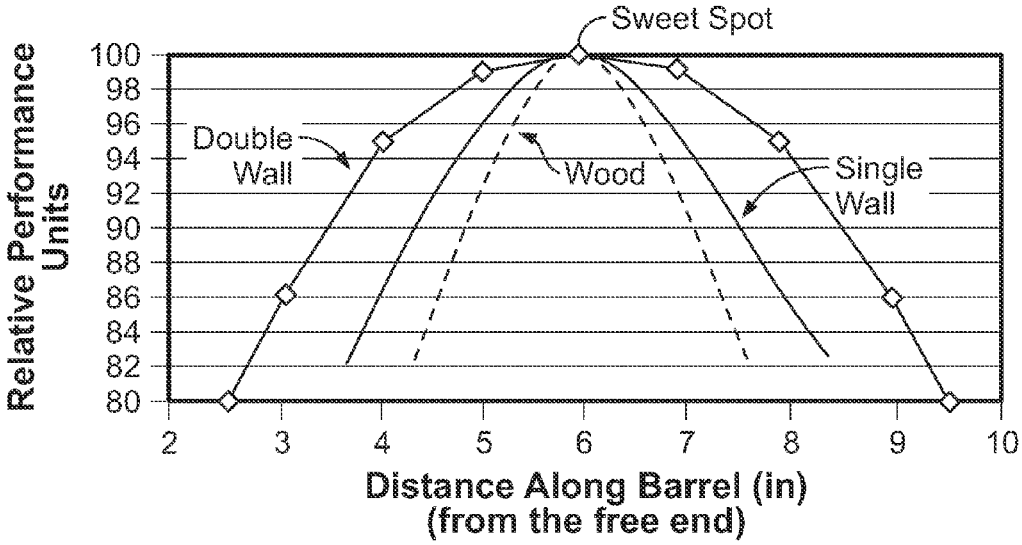
FIG. 2 is a graph comparing relative performance characteristics of a typical wood bat barrel, a typical single-wall bat barrel, and a typical double-wall bat barrel.
Figure 8:
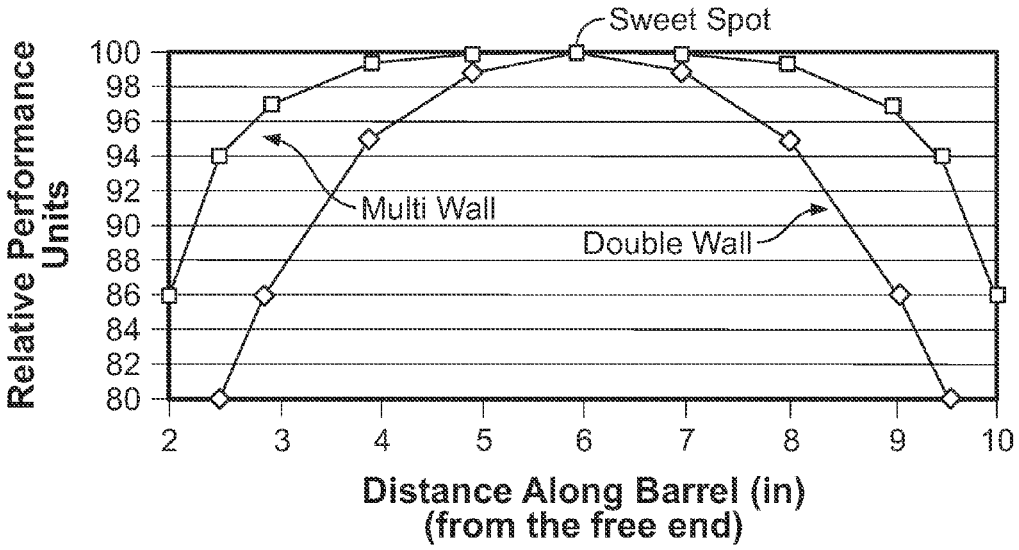
FIG. 8 is a graph comparing relative performance characteristics of a typical double-wall bat barrel and a bat barrel utilizing multiple interface shear control zones to create a "multi-wall" bat.

FIG. 8 shows a graphical comparison of the relative performance characteristics of a typical double-wall bat barrel (the double-wall barrel curve in the graph of FIG. 8 is the same as the double-wall barrel curve shown in the graph of FIG. 2), and a "multi-wall" bat barrel incorporating additional ISCZs in Zones 1 and 2 of the bat barrel 14. As FIG. 8 illustrates, by locating additional ISCZs in Zones 1 and 2 of the bat barrel 14, performance is generally improved along the length of the barrel 14 as compared to a typical double-wall bat.

Figure 9:
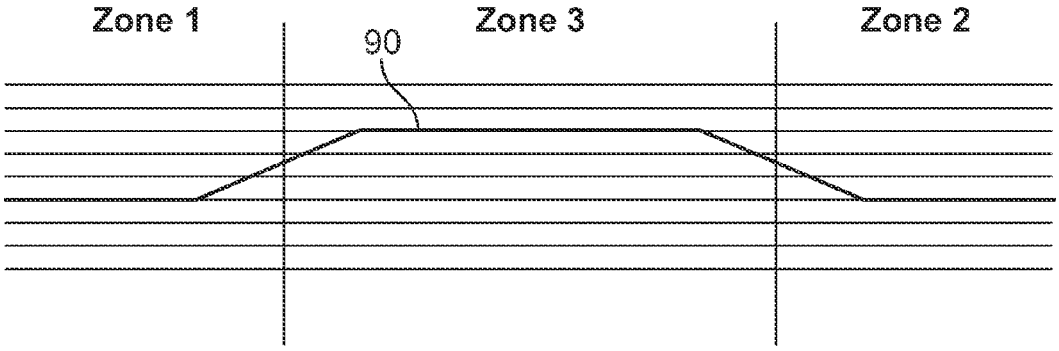
FIGS. 9-10 are cross-sections of Zones 1-3 of the bat barrel shown in FIG. 3, according to two alternative embodiments.
Figure 10:
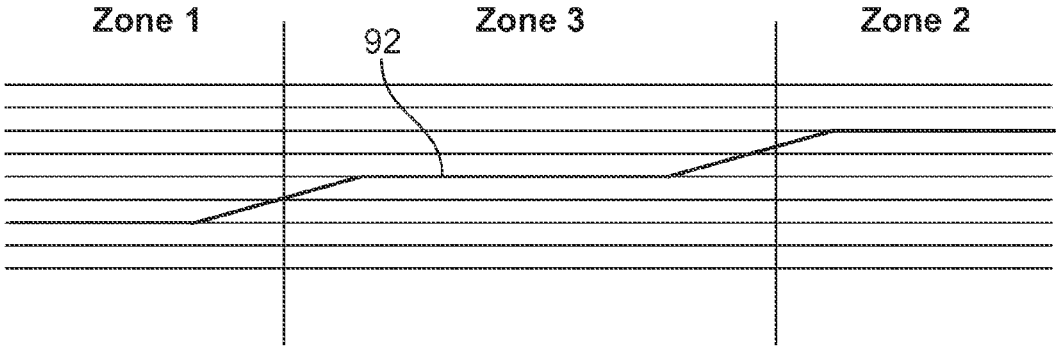

FIGS. 9 and 10 illustrate alternative embodiments in which a single continuous ISCZ passes through Zone 1, Zone 3, and Zone 2 of the bat barrel, essentially forming a double-wall bat barrel. The single continuous ISCZs in these embodiments, however, intersect more than one ply in each of Zones 1, 2, and 3, i.e., the thickness of each of the barrel walls varies throughout the length of the barrel. Accordingly, the bat barrel does not perform like a typical double-wall barrel having a single continuous ISCZ running along the length of the barrel at substantially the same radial location.

FIG. 9 illustrates a bat barrel including a single continuous ISCZ 90 that runs closer to the outer surface of the barrel 14 in Zone 3 than in Zones 1 and 2. FIG. 10 illustrates a bat barrel including a single continuous "stepped" ISCZ 92 that runs closer to the outer surface of the barrel 14 in Zone 2 than in Zone 3, and closer to the outer surface of the barrel 14 in Zone 3 than in Zone 1. The continuous ISCZ need not be symmetric, and it may be positioned inversely to the embodiments shown in FIGS. 9 and 10, or it may be oriented in any other suitable fashion. By varying the location of the single continuous ISCZ throughout the bat barrel, the sweet spot of the barrel may be increased and/or modified. In an alternative embodiment, the continuous ISCZ may intersect greater than one ply in a lesser number of zones or barrel regions, such that the thickness of the barrel walls varies only in those regions.

The present invention further contemplates locating ISCZs in the bat handle 12 and/or the tapered section 16 (to provide increased deformation for off-barrel hits) of the ball bat 10, to provide increased deflection in those regions. Use of ISCZs in the bat handle 12 provides increased handle compliance, due to the efficient energy transfer resulting from bending deformation, as opposed to shear deformation. In addition, by using one or more ISCZs to de-couple the handle 12, the "feel" of the bat 10 is improved, as a greater number of interfaces are provided for dissipating vibration energy.

When one or more ISCZs are placed in the handle 12 near the tapered section 16, the ball bat 10 exhibits a quicker "snap back" to axial alignment during a swing than if the ISCZ(s) are placed closer to the user grip location of the handle 12. This quicker snap back is generally preferred by skilled players who generate high swing speeds. Placing ISCZs closer to the grip location on the handle 12 tends to rob skilled players of control, as the bat 10 is too slow to return to the axial position at or just prior to the time of ball impact.

For novice players, however, it may be preferable to locate ISCZ(s) in the bat handle 12 closer to user the grip location, since lesser-skilled players tend to "push" the bat through the strike zone, and therefore do not cause the bat 10 to "bend" significantly out of axial alignment. Those skilled in the art, therefore, will recognize that the placement of the ISCZs in the handle 12 is generally dependent upon the flexibility of the remaining bat handle 12, the weight of the bat barrel 14, the skill level of the intended user, and the materials used in the handle 12.

The ball bat 10 is generally constructed by rolling the various layers of the bat 10, including the ISCZs, onto a mandrel or similar structure having the desired bat shape. The ISCZs are strategically placed and oriented, as described in the above embodiments, to achieve increased deflection and trampoline effect in Zone 1 and/or Zone 2 of the bat barrel 14. Additionally, or alternatively, ISCZs may be placed in the handle 12 and/or the tapered section 16 of the ball bat 10 to increase deflection in those regions.

The ends of the layers are preferably "clocked," or offset, from one another so that they do not all terminate at the same location before curing. Accordingly, when heat and pressure are applied to cure the bat 10, the various barrel layers blend together into a distinctive "one-piece," or integral, multi-wall construction. Put another way, all of the layers of the bat are "co-cured" in a single step, and blend or terminate together at least one end, resulting in a single-piece, multi-wall structure with no gaps (at the at least one end), such that the barrel 14 is not made up of a series of tubes, each with a wall thickness that terminates at the ends of the tubes. As a result, all of the layers act in unison under loading conditions, such as during striking of a ball.

The blending of the layers into a single-piece, multi-wall construction, like tying the ends of a leaf spring together, offers an extremely durable assembly, particularly when impact occurs at the extreme ends of the layer separation zones. By blending the multiple layers together, the barrel 14 acts as a unitized structure where no single layer works independently of the other layers. One or both ends of the barrel 14 may terminate together in this manner to form the one-piece barrel 14. In an alternative design, neither of the barrel ends terminates together in this manner.

The described bat construction, and method of making the same, provides a bat 10 having excellent "trampoline effect" throughout the length of the barrel 14. These results are primarily due to the selection and strategic placement of ISCZs (which may also be placed in the handle 12 and/or the tapered section 16 of the bat 10 to increase deflection in those regions) in the barrel 14. Additionally, the optional step of blending the barrel layers together in a single curing step provides for increased durability, especially during impact at the extreme ends of the barrel layers.

Thus, while several embodiments have been shown and described, various changes and substitutions may of course be made, without departing from the spirit and scope of the invention. The invention, therefore, should not be limited, except by the following claims and their equivalents.

What is claimed is:

1. A ball bat, comprising:

a barrel;

a handle comprising a plurality of structural, fiber-reinforced composite layers;

at least one interface shear control zone separating at least two of the structural composite layers in the handle, wherein each interface shear control zone separates the handle into two regions along the length of the interface shear control zone and prevents shear energy transfer between the two regions;

a tapered section joining the barrel to the handle; and at least one additional interface shear control zone in the tapered section.

2. The ball bat of claim 1 wherein the handle has a substantially uniform thickness.

3. The ball bat of claim 1 wherein at least one of the interface shear control zones extends from the handle through the tapered section into the barrel.

4. The ball bat of claim 1 wherein the handle includes a grip region, and wherein at least one of the interface shear control zones is located adjacent to the grip region.

5. The ball bat of claim 1 wherein at least one of the interface shear control zones is located adjacent to the tapered section.

6. A ball bat, comprising:

a barrel;

a handle comprising a plurality of fiber-reinforced composite layers;

at least two interface shear control zones each separating at least two of the fiber-reinforced composite layers in the handle, wherein each interface shear control zone separates the handle into two regions along the length of the interface shear control zone and prevents shear energy transfer between the two regions; and a tapered section joining the barrel to the handle.

7. The ball bat of claim 6 wherein the handle has a substantially uniform thickness, and wherein two interface shear control zones are located substantially at one third and two thirds of the handle thickness.

8. The ball bat of claim 6 wherein at least one of the interface shear control zones extends into the tapered section of the ball bat.

9. The ball bat of claim 6 wherein at least one interface shear control zone extends from the handle through the tapered section into the barrel.

10. The ball bat of claim 6 wherein at least two interface shear control zones extend from the handle through the tapered section into the barrel.

11. The ball bat of claim 6 wherein the handle includes a grip region, and wherein at least one of the interface shear control zones is located adjacent to the grip region.

12. The ball bat of claim 6 wherein at least one of the interface shear control zones is located adjacent to the tapered section.

13. A ball bat, comprising:

a barrel;

a handle comprising a plurality of fiber-reinforced composite layers;

means for separating, and preventing shear energy transfer between, at least two of the composite layers in the handle, wherein the means for separating is located substantially at a radial midpoint of the handle; and a tapered section joining the barrel to the handle.

14. The ball bat of claim 13 wherein the handle has a substantially uniform thickness.

15. The ball bat of claim 13 wherein the handle includes a grip region, and wherein the means for separating is located adjacent to the grip region.

16. The ball bat of claim 13 wherein the means for separating is located adjacent to the tapered section.

17. The ball bat of claim 13 wherein the means for separating extends from the handle into the tapered section.

18. A ball bat, comprising:

a barrel;

a handle comprising a plurality of fiber-reinforced composite layers;

at least one interface shear control zone separating at least two of the composite layers in the handle, wherein each interface shear control zone separates the handle into two regions along the length of the interface shear control zone and prevents shear energy transfer between the two regions;

a tapered section joining the barrel to the handle;

wherein at least one of the interface shear control zones extends into the tapered section.

* * * * *